United States Patent [19]

Buffington et al.

[11] 4,126,946

[45] Nov. 28, 1978

[54] GRAIN DRYING APPARATUS AND PROCESS

[76] Inventors: James F. Buffington, R.R. #4, Plymouth, Ind. 46563; Lee E. Norris, R.R. #1, Box 341, Mentone, Ind. 46539

[21] Appl. No.: 794,063

[22] Filed: May 5, 1977

Related U.S. Application Data

[62] Division of Ser. No. 701,284, Jun. 30, 1976, Pat. No. 4,045,882.

[51] Int. Cl.[2] ..... F26B 17/12

[52] U.S. Cl. ..... 34/13; 34/66; 34/171; 34/178; 34/203; 34/216; 432/78

[58] Field of Search ..... 34/10, 13, 30, 66, 171, 34/178, 203, 205, 236, 215–217, 20; 432/78, 81, 85, 133, 128–130

[56] References Cited

U.S. PATENT DOCUMENTS

| | | | |
|---|---|---|---|
| 1,239,246 | 9/1917 | Allan | 432/128 |
| 2,419,875 | 4/1947 | Birdeye | 34/203 |
| 2,419,876 | 4/1947 | Birdeye | 34/203 |
| 2,452,983 | 11/1948 | Birdeye | 34/13 |
| 3,060,589 | 10/1962 | Wallin | 34/171 |
| 3,673,699 | 7/1972 | Buffington | 34/236 |
| 3,839,803 | 10/1974 | Dick | 432/78 |

*Primary Examiner*—Henry C. Yuen
*Attorney, Agent, or Firm*—Marmaduke A. Hobbs

[57] ABSTRACT

A process for drying grain in which the grain is first heated to drive off a portion of the moisture as it passes along a conveyor, and the heated and partially dried grain is then discharged into a holding or steeping bin where the moisture in the center of the kernels migrates to near the surface and the temperature becomes substantially uniform throughout. The grain is then discharged onto a second belt where the grain is first heated to drive off a substantial part of the moisture remaining in the grain and then is cooled before it is discharged from the apparatus. Air is used to cool the grain before it is discharged and this partially heated air is utilized in both grain heating operations.

6 Claims, 3 Drawing Figures

GRAIN DRYING APPARATUS AND PROCESS

This application is a division of application Ser. No. 701,284 filed June 30, 1976, now U.S. Pat. No. 4,045,882.

In the past some widely used grain drying equipment has had a number of inherent disadvantages, including damage to the grain through compression and abrasion of the grain, inefficiency of operation through ineffective utilization of the heat required for drying the grain, and inability to handle and dry grain which has not been carefully cleaned prior to the grain drying operation. Further, prior grain drying apparatus have often been relatively bulky and difficult to transport and install and have required excessive space to use and operate properly, and have involved the use of high speed augers or other conveyors for loading and unloading which not only often damaged the grain but also made the apparatus initially expensive and thereafter costly to service and maintain. Many of the foregoing disadvantages have been overcome by the grain drying apparatus disclosed and claimed in U.S. Pat. No. 3,673,699 which gently handles the grain in a relatively thin layer without the use of high columns of grain or lift conveyors, and which increases the efficiency of the drying operation by utilizing the incoming circulating air to cool the dried grain, and thereafter utilizing the heat absorbed in the cooling step to assist in the grain drying step. While this improved grain drying apparatus performs satisfactorily in many operations, in view of the relatively high cost of fuel, attempts have been made to economize on fuel by limiting the time in which the grain is processed by the apparatus. These attempts have, in the past, resulted in decreased efficiency and effectiveness of the apparatus and inadequate drying of the grain. It is therefore one of the principal objects of the present invention to provide a grain drying apparatus which gives good fuel economy while maintaining a high performance level in the apparatus, and which is so constructed and designed that the heat is reused in a multiple stage drying operation resulting in good efficiency and effective drying of the grain in a relatively short period of time.

Another object of the invention is to provide a grain dryer apparatus and process in which the grain is subjected to a series of steps consisting of a first drying operation which removes the moisture near the surface of the kernels, a steeping operation in which the grain is permitted to cool and the moisture in the kernels permitted to flow from the center to the surface, and a second drying operation which removes a substantial amount of the moisture remaining in the grain following the steeping operation.

A further object is to provide a grain drying apparatus of the aforesaid type which can effectively be controlled by varying the flow rate of the grain through the apparatus, and which can easily be so controlled that it gives optimum drying performance for a variety of different grains, such as for example soybeans and shelled corn or ear corn.

Additional objects and advantages of the invention will become apparent from the following description and accompanying drawings, wherein.

Figure 1:
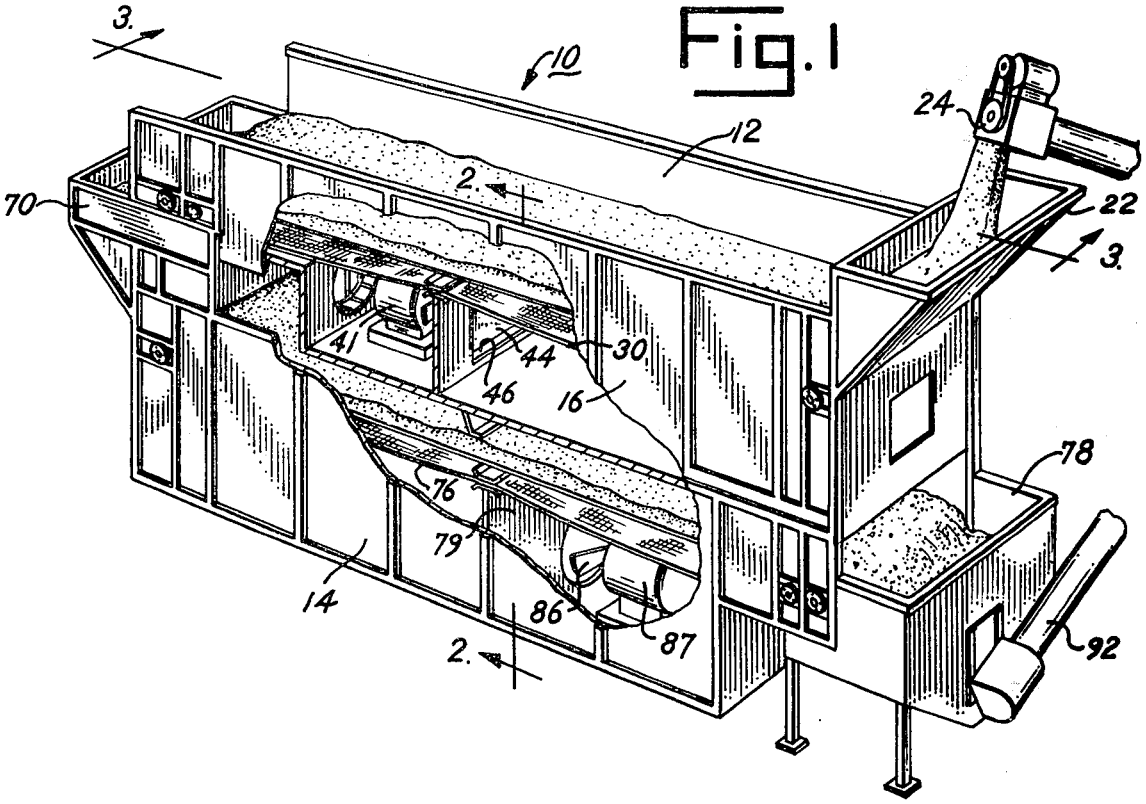
FIG. 1 is a perspective view of the present grain drying apparatus with a portion of the side wall broken away to show the internal mechanism for performing the present process.
Figure 2:
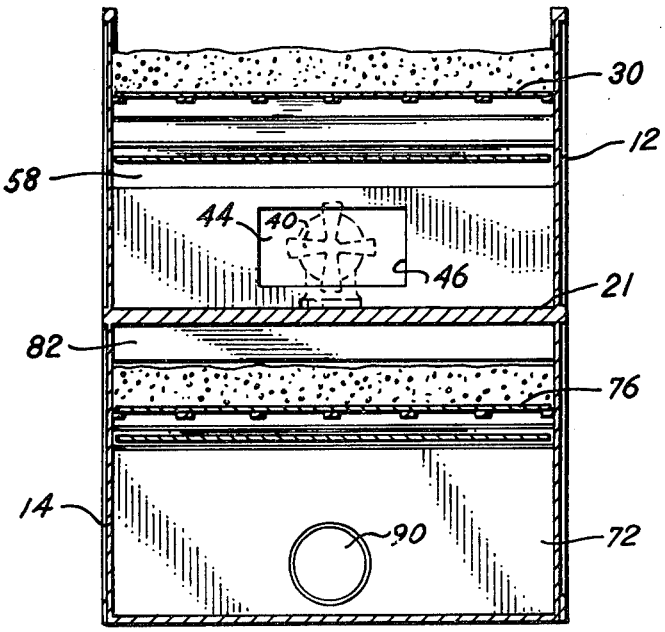
FIG. 2 is a vertical transverse cross sectional view taken on line 2 — 2 of FIG. 1.

Referring more specifically to the drawings, and to FIG. 1 in particular, numeral 10 designates generally the present grain drying apparatus shown with grain therein and in operation performing the present process. While the apparatus is relatively large, it is preferably of a size which will permit prefabrication and transportation on the highway on a semi-trailer or similar mode of transportation. However, the apparatus may be of various sizes to satisfy requirements, and may be fabricated in sections or modules which can be assembled at the location where the apparatus is to be installed and operated.

Figure 3:
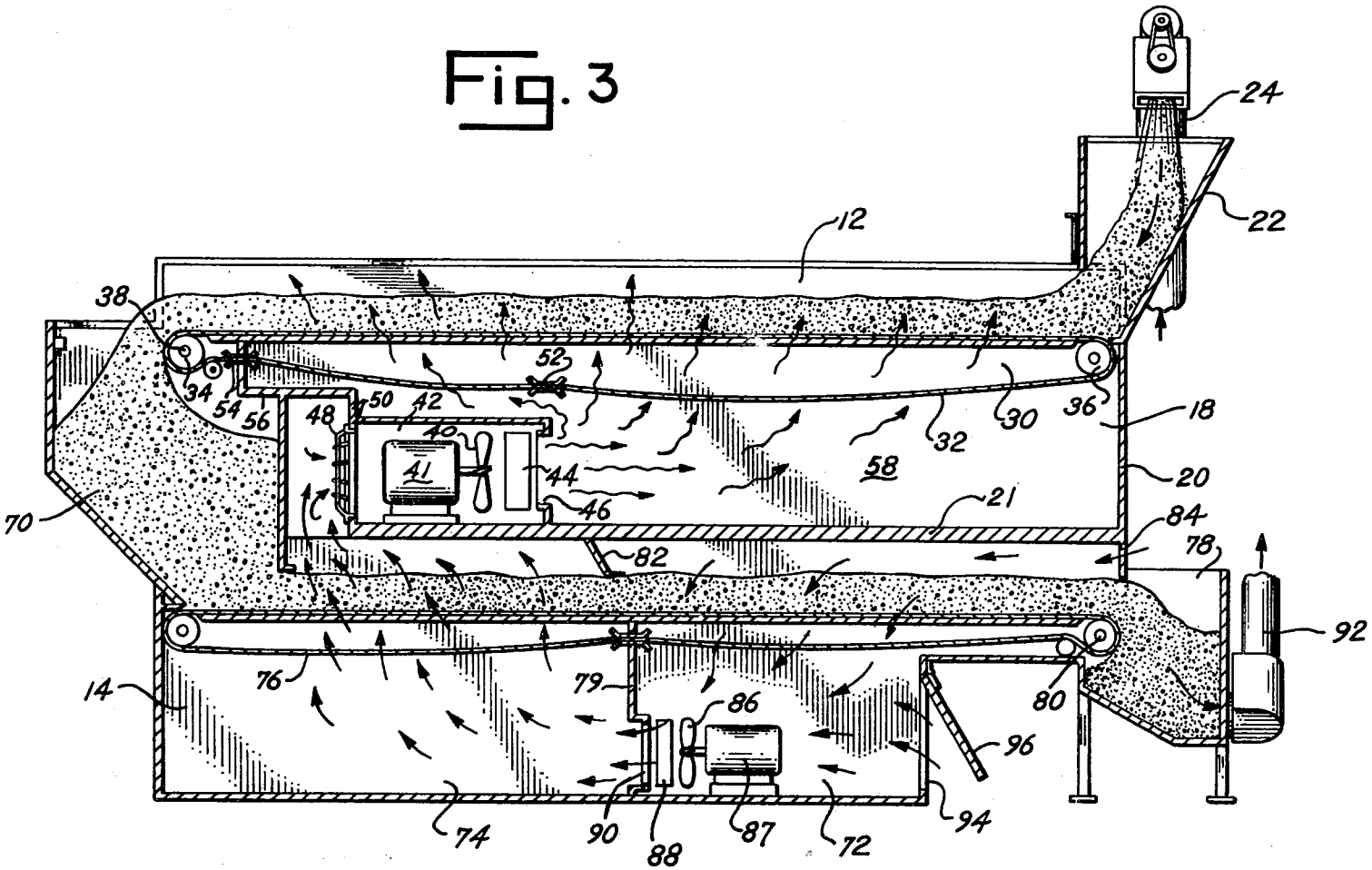
FIG. 3 is a longitudinal cross sectional view of the grain drying apparatus shown in the preceding figures, the section being taken on line 3 — 3 of FIG. 1.

The apparatus consists of an upper section 12 and a lower section 14, the upper section having two side walls 16 and 18, an end wall 20 connected to the two side walls, and a horizontal partition 21 which separates the two sections. In the view shown in the drawings, no cover or top is illustrated; however, under certain conditions it may be desirable to enclose the top part of the upper section 12. Mounted on the right hand end of the upper section, as viewed in FIGS. 1 and 3, is a hopper 22 which receives grain, such as corn, beans, peanuts, wheat, oats, rye, mailo, cobs, shucks, or fibrous material, from an auger conveyor 24 which discharges the grain or other material to be dried into the hopper. The material to be dried will, for convenience of description, be referred to as "grain". A conveyor 30 is mounted in the upper part of section 12 and consists of a continuous belt 32 of porous material trained on pulleys 34 and 36 at the opposite ends of section 12. The belt may be steel wire web material of a mesh large enough in size to permit the air to pass freely therethrough, but small enough to prevent the grain from falling therethrough. The belt is driven by a motor through a gear reduction unit (not shown), the drive motor normally being operatively connected to pulley 34 on an extension shaft 38 of the pulley, the motor normally being mounted on the outer side of the upper section.

A fan or blower 40 driven by a motor 41 is mounted in a compartment 42 in the lower part of section 12 and creates an air flow through heater unit 44 and through opening 46 in the end of the compartment. Air is drawn in through opening 48 in the opposite end wall 50 of the compartment, from lower section 14, as will be more fully explained hereinafter. The lower portion of the belt is supported by two support members 52 and 54, the latter being disposed in partition 56 forming the end wall for space or compartment 58 of the upper section.

The grain discharged into hopper 22 flows by gravity onto belt 32 and is moved from right to left, as viewed in FIGS. 1 and 3, at a relatively slow rate, and is discharged into holding or steeping bin 70 disposed at the left hand end of section 12 where the grain remains for a predetermined period without being subjected to either air flow or heat. The grain is held in the bin to permit the moisture in the center of the grain not removed by the heated air passing through the grain on belt 32, to migrate from the center to the outside surface where it can effectively be removed as the grain passes through the lower section 14.

The lower section 14 is similar in construction to the upper section; however, the operation is somewhat different. The lower section consists of an air intake compartment 72 and a heated air compartment 74. A conveyor 76 is disposed in the lower section extending from bin 70 at the left hand end to the receiving hopper 78 on the right hand end of the section. The construction and operation of the belt and pulleys for the conveyor are the same as or similar to the construction and operation of conveyor 30, the belt preferably being constructed of wire mesh or other suitable material which will permit the air to pass upwardly therethrough without permitting the grain to fall downwardly therethrough. The two compartments are separated by a partition 79, and the lower portion of the conveyor belt passes from one compartment to the other through partition 79, which is provided with a support means for the lower section of the belt. The belt is driven by a motor (not shown) connected to a shaft 80.

Grain is discharged from bin 70 onto conveyor 76 as the upper section of the conveyor moves from left to right carrying the grain from bin 70 to hopper 78. An air lock baffle 82 is disposed near the mid-section of the conveyor belt to direct cool fresh air entering opening 84 downwardly through the grain and the conveyor belt, into compartment 72 where it is forced by a fan or blower 86 driven by motor 87, through heat exchanger 88 and opening 90 into compartment 74. The air then travels upwardly from compartment 74 through the belt and grain, and passes through opening 48 into compartment 42 where it is again heated by heating unit 44 before being discharged through the grain on conveyor 30. The air entering opening 84 is cool air, and hence cools the grain before it is discharged into hopper 78. The air passing downwardly through the grain is heated by the heat from the grain, and is further heated by heater 88 before it is discharged into compartment 74 and forced upwardly through the grain on the left hand side of baffle 82. As the grain passes along the conveyor 76, the moisture, which has migrated from the center of the grain to the external surface or near the external surface while the grain was in hopper 78, is removed by the air passing upwardly therethrough from compartment 74. After the grain has been discharged from conveyor 76 into hopper 78, it is removed by an auger 92 connected to the lower portion of hopper 78. In order to regulate the temperature of the air passing from compartment 72 to compartment 74, a ventilating opening 92 is provided in the end of compartment 72, the amount of air entering opening 94 being controlled by the position of door 96 hinged to the end wall of the compartment.

In the operation of the present grain drying apparatus, the grain or other material to be dried is discharged from auger 24 into hopper 22 and is carried by conveyor 32 from the hopper along the upper surface of the conveyor to bin 70. As the grain is carried along the conveyor, heated air from heater 44 passes upwardly through the porous conveyor and the grain thereon, in somewhat the same manner as indicated by the arrows, throughout substantially the entire length of the conveyor, thus heating the grain and removing a substantial amount of the moisture near the surface. The grain is then discharged into bin 70 and is permitted to remain in the bin, wherein the temperature and moisture in the grain become more or less uniform throughout the grain, without being subjected to either air flow or heat. During this steeping operation, moisture migrates from the center of the grain to the surface or near the surface where it can easily be removed in the second operation performed in the lower section 14 which is normally operated simultaneously with the operation of section 12. Conveyor 76 carries the grain from bin 70 to hopper 78, and fresh air drawn inwardly through opening 84 passes downwardly through the grain, thereby cooling the grain to substantially normal temperature. The partially heated air entering comparment 72 from the grain is again heated by heater 88 and is forced by blower 86 through compartment 74 and upwardly through the grain to compartment 42, where blower 40 forces the air through heater 44 into compartment 58 and upwardly through the grain on the conveyor, as previously explained herein. The temperature of the air entering compartment 74 is partially controlled by air inlet 94 and door 96 which can be moved from fully closed to fully opened position to satisfy operating conditions and moisture content of the grain.

The present invention also involves the process in which the grain or other material to be dried is first heated to a temperature sufficient to drive off a substantial amount of moisture, consisting of the steps of heating the grain to drive off a substantial amount of moisture, holding the grain in a steeping bin or other suitable container without forced air passing therethrough, in order to permit the moisture in the center of the grain, not removed in the first step, to migrate to the surface or near the surface of the grain, and, in a third step, heating the steeped grain to a temperature sufficient to drive off the moisture which migrated to the surface or near the surface, and then cooling the grain to normal or substantially room temperature before it is discharged. The sequence of steps involving a first heating operation, a holding operation and then a second heating operation followed by a cooling operation, are important in obtaining the optimum results in drying the grain or other material, and are particularly adapted for performance by the apparatus shown in the drawings and described herein. The temperature used in the heating steps to drive off the moisture can vary over a wide range, and is principally determined by the speed of the conveyors and the amount of grain on each conveyor.

While only one embodiment of the present apparatus and process has been described in detail herein, various changes and modifications may be made without departing from the scope of the invention.

We claim:

1. A method of drying grain using apparatus having a first grain conveyor, a second grain conveyor, and a grain receiving container disposed operationally between said conveyors: said method comprising heating the grain in the first conveyor to a temperature sufficient to drive off the moisture near the surface of the kernels while leaving the moisture near the center, holding the grain in mass without substantial cooling in said grain receiving container for a period of time to permit the moisture near the center of the kernels to migrate to near the surface and the kernels to become of a substantially uniform temperature, heating the grain in said second conveyor to a temperature and for a time sufficient to drive off the migrated moisture, and thereafter cooling the grain to ambient temperature.

2. A method of drying grain as defined in claim 1 in which cool air is drawn through the grain to cool the grain in the final cooling stage, and the air thus heated in said cooling step is further heated for heating the grain in both of said heating steps.

3. A method of drying grain as defined in claim 1 in which the grain is partially cooled during said holding step.

4. A method of drying grain as defined in claim 2 in which the grain is partially cooled during said holding step.

5. A method of drying grain as defined in claim 3 in which the cooling of the grain between the heating steps is performed slowly.

6. A method of drying grain as defined in claim 4 in which the cooling of the grain between the heating steps is performed slowly.

* * * * *